US005151564A

United States Patent [19]

Rowe

[11] Patent Number: 5,151,564

[45] Date of Patent: Sep. 29, 1992

[54] OPERATING MECHANISM FOR A CIRCUIT BREAKER

[75] Inventor: Neal E. Rowe, Asheville, N.C.

[73] Assignee: Westinghouse Electric Corp., Pittsburgh, Pa.

[21] Appl. No.: 653,608

[22] Filed: Feb. 11, 1991

[51] Int. Cl.[5] ..... H01H 3/00; H01H 15/00

[52] U.S. Cl. ..... 200/17 R; 200/332; 74/102; 74/544

[58] Field of Search ..... 200/17, 501, 332, 330; 74/102, 109, 544; 361/379

[56] References Cited

U.S. PATENT DOCUMENTS 3,752,947 8/1973 Strobel ..... 200/332

4,178,624 12/1979 Wilson et al. .

FOREIGN PATENT DOCUMENTS 221133 9/1973 Fed. Rep. of Germany ..... 200/332

*Primary Examiner*—Harold Broome

*Attorney, Agent, or Firm*—M. J. Moran

[57] ABSTRACT

An operating mechanism for the operation of a circuit breaker by movement of a toggle handle in a vertical plane and a switch handle movable in a horizontal plane, and comprising a housing, a shaft, a toggle handle and a gear plate mounted on the shaft, and a pivot plate. The pivot plate has slots arranged in an arcuate path, a butterfly cut-out section which receives and engages the switch handle of the circuit breaker, and an arcuate opening and pin arrangement for guiding the pivot plate in its pivotal movement. The gear plate has a flat portion and an arcuate portion with gear teeth. These gear teeth on the gear plate enter the slots in the pivot plate to rotate the pivot plate for operation of the switch handle. Rotation of the pivot plate is generated by movement of the toggle handle in a vertical plane.

18 Claims, 4 Drawing Sheets

OPERATING MECHANISM FOR A CIRCUIT BREAKER

BACKGROUND OF THE INVENTION

1. Field of the Invention

This invention relates to an operating mechanism for a circuit breaker, and more particularly, to a slide toggle type arrangement for the operation thereof.

2. Description of the Prior Art

Several circuit breakers are mounted in a control center for power consuming devices such as motors. Each of these circuit breakers are vertically mounted with their switching handles being movable in a vertical plane. Conventionally, the "ON" position is "UP" for the switch handle and the "OFF" is "DOWN" for the switch handle.

Presently, each of these circuit breakers are operated by an operating mechanism having a toggle handle which extends through the door or cover of the control center. The toggle handle extends outwardly for movement in an upward and downward direction in a vertical plane. This movement of the toggle handle causes the toggle mechanism to move the switch handle of the circuit breaker in a parallel fashion in a vertical plane where the "UP" position is "ON" for the circuit breaker and the "DOWN" position is "OFF". An extreme down position of the handle is used to reset the circuit breaker.

Conventionally, this operating mechanism is attached to the circuit breaker by a frame for insertion and removal as a unit from the control center. This unit is placed on a shelf in the control center, and the toggle handle protrudes through an opening in the door of the control center. An example of such a circuit breaker assembly with an operating mechanism attached to the circuit breaker by a frame is disclosed and illustrated in U.S. Pat. No. 4,178,624 entitled "Control Center with Insulated Bus Bars", which issued Dec. 11, 1979 to J. R. Wilson, et al.

Present day operating mechanisms may be of the slide/toggle type as discussed in U.S. Pat. No. 4,178,624 or of the rotary type. In both types, the operation of the external toggle handle is in line with and parallel to the circuit breaker. That is, if the breaker is mounted vertically in the control center, the circuit breaker is operated by moving the toggle handle in a vertical plane as disclosed in U.S. Pat. No. 4,178,164, and conversely, if the circuit breaker is mounted horizontally, the circuit breaker is operated by moving the toggle handle in a horizontal plane.

In today's market, there an is increasing amount of pressure to mount the circuit breakers and/or the power control centers in a more economical and compact fashion. As a result, these control centers or circuit breaker units are being redesigned to mount some or all of their components horizontally as opposed to the traditional vertical type mounting.

Presently, there exists no operating mechanism for the operation of a circuit breaker in the traditional "vertical sense," where "ON" is the "UP" position and "OFF" is in the "DOWN" position for the toggle handle, when the circuit breaker is mounted horizontally in a control center. When a circuit breaker is placed horizontally in a control center, the present day type of operating mechanism is moved back and forth in a horizontal plane for operation of the circuit breaker as discussed herein above.

SUMMARY OF THE INVENTION

The present invention has solved the above described problems by providing a toggle-handle operating mechanism for operating a circuit breaker in the traditional "vertical sense", particularly, when the circuit breaker is placed or mounted horizontally in the control center.

The present invention provides an operating mechanism having a housing which is secured to a door of the power control center. This housing projects through an opening in the door of the control center for its connection to the circuit breaker. Mounted in the housing as a unit is a pivot plate, a shaft, a gear plate, and a toggle handle. The gear plate and toggle handle are mounted on the shaft. The toggle handle is moved in a vertical plane for operation of the circuit breaker.

The pivot plate is attached to the housing at two locations by pins or screws. One of the locations is a pivot point for the pivot plate. The pivot plate has a butterfly opening, an arcuate opening, and several gear slots arranged in an arcuate path on the face of the pivot plate. When the door to the control center is closed the butterfly opening receives the switch handle of the circuit breaker. This opening has concave surfaces which engage the switch handle upon movement of the pivot plate. The arcuate opening receives the other of the two pins for attaching the pivot plate to the housing and acts to guide the pivot plate when it is rotated by the gear plate.

The gear plate has a flat area and a gear section. The gear section has an arcuate configuration in both an x-y plane and a y-z plane, and has gear teeth around its periphery. These gear teeth correspond to and enter into the slots in the pivot plate.

Movement of the toggle handle in a vertical plane imparts rotation to the gear plate, which, in turn causes the pivot plate to move in a clockwise or counterclockwise direction. This results in movement of the switch handle of the circuit breaker in a horizontal plane. Specifically, when the toggle handle is moved upwardly from a nonoperating mode, the pivot-plate moves in a counterclockwise direction for an "ON" mode for the circuit breaker. When the handle is moved downwardly, the pivot plate rotates in a clockwise direction for an "OFF" or for a "RESET" mode for the circuit breaker.

It is, therefore, an object of the present invention to provide an operating mechanism associated with a switch handle of a circuit breaker for translating the vertical movement of a toggle handle of the operating mechanism into a horizontal movement of the switch handle when the switch handle is in a horizontal plane for its operation.

It is a further object of the present invention to provide an operating mechanism for operating a circuit breaker in the traditional "vertical" sense when the circuit breaker is mounted horizontally in a control center.

It is a further object of the present invention to provide a toggle handle of an operating mechanism for a circuit breaker where the "UP" positioning translates into an "ON" mode for a switch handle of the circuit breaker, and the "DOWN" mode translates into an "OFF" or a "RESET" mode for a switch handle of the circuit breaker.

It is a broad object of the present invention to provide an operating mechanism for a circuit breaker whereby movement of a toggle handle of the mechanism in a vertical plane translates into movement of a switch handle of the circuit breaker in a horizontal plane for operation of the circuit breaker.

A still further object of the present invention is to provide a toggle-type operating mechanism for a circuit breaker which is easily mounted on a door of a control center for interconnection with a switch handle of the circuit breaker when the door is closed.

These and other objects of the present invention will be more fully understood and appreciated from the following description of the invention, on reference to the illustrations appended thereto.

DETAILED DESCRIPTION OF A PREFERRED EMBODIMENT

Figure 1:
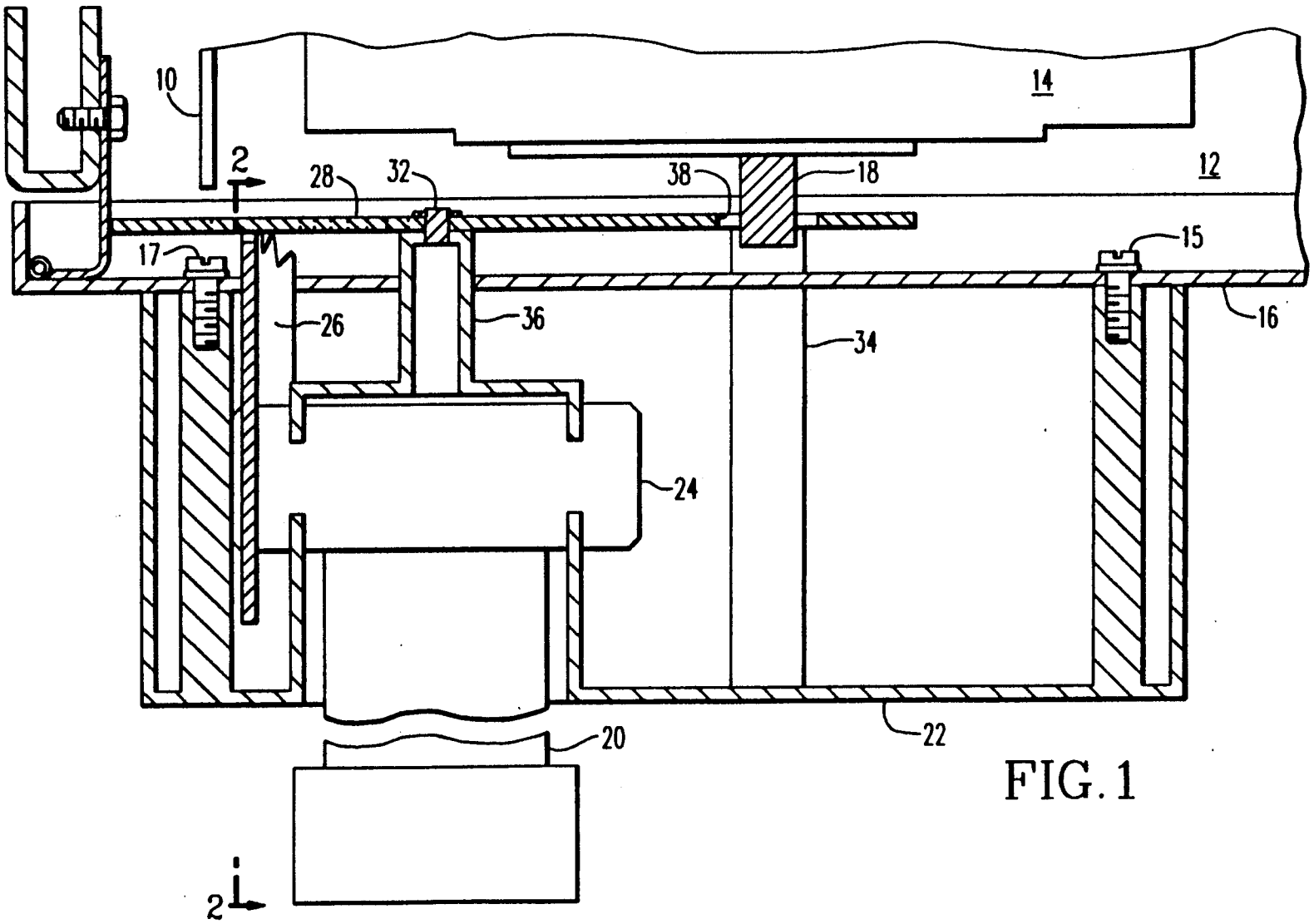
FIG. 1 is a cross-sectional top plan view of an operating mechanism of the invention in a power control center.

FIG. 1 shows part of an enclosure 10 for a power control center. This enclosure 10 has a unit opening 12 for the mounting of a circuit breaker 14. Access to unit opening 12 is through door 16. An example of such a control center is disclosed and illustrated in U.S. Pat. No. 4,178,624 discussed hereinbefore. The control center of this '624 patent has several unit openings with several circuit breakers 14 which are enclosed by one or more doors 16. The invention may reside in a control center having several unit openings 12 with circuit breakers 14, however the invention is described herein with reference to only one unit opening 12 with its respective circuit breaker 14 and door 16.

Circuit breaker 14 may be a series Ⓦ F frame or other type of breaker and is supported in opening 12 through means well-known in the industry. This circuit breaker 14 typically would be inserted in the enclosure 10 in an upright position for operation of both the switch handle 18 and a toggle handle 20 in a vertical plane.

However, for economic reasons, circuit breaker 14 is mounted on its side, whereby switch handle 18 is moved by the operating mechanism of the present invention from a neutral position to the right or from a neutral position to the left when viewing FIG. 1. If switch handle 18 is moved to the right in FIG. 1, the first setting would be an "OFF" mode, and the second setting to the extreme right would be a "RESET" mode for circuit breaker 14. Position of switch handle 18 as shown in FIG. 1 is a "TRIP" mode for the circuit breaker 14, and movement of switch handle 18 to the left in FIG. 1 would be an "ON" mode for circuit breaker 14.

Door 16 is attached to a corner post-pivot point hinge arrangement shown in the upper left hand corner of FIG. 1. This arrangement is well-known in the art and therefore requires no further discussion.

Referring to all the FIGS. 1–5, the operating mechanism of the present invention comprises toggle handle 20, housing 22, shaft 24, gear plate 26, and pivot plate 28. These components are assembled together as a unit prior to housing 22 being secured to door 16.

Figure 2:
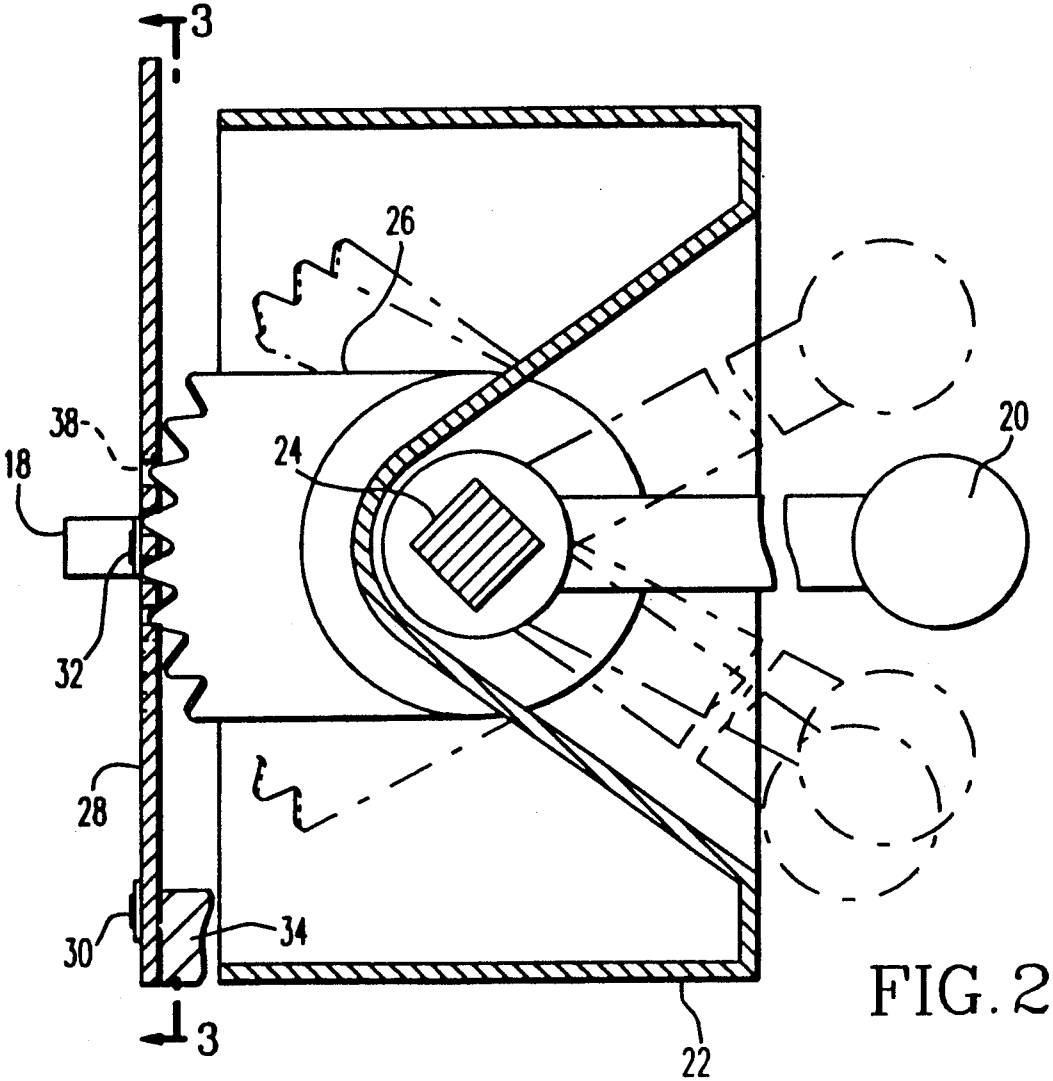
FIG. 2 is a cross sectional side view of an operating mechanism of the invention taken along lines 2—2 of FIG. 1.

Housing 22 is a one-piece molded plastic construction having an indented area as particularly shown in FIGS. 1 and 2 for receiving shaft 24, which is mounted in the side walls of housing 22.

Housing 22 is preferably rectangular in shape and has several molded sections or bosses for receiving fastening means such as pins or screws for securing housing 22 to door 16. The screws are inserted into the molded bosses from the inside of door 16. Preferably, a molded boss for receiving a screw, two of which are shown at 15 and 17, is located in each of the four corners of housing 22.

Shaft 24 and toggle handle 20 are of a well-known construction and are mounted in the side walls of housing 22 through conventional bearings and E-rings in a manner wellknown in the art.

The present invention resides primarily in the construction and interrelationship of gear plate 26 and pivot plate 28, and its arrangement or mounting in housing 22. Gear plate 26 is mounted onto shaft 24, and pivot plate 28 is attached to housing 22 through pin means 30 and 32 shown particularly in FIGS. 1–3. Pin means 30 is a pivot point for pivot plate 28, and pin means 32 will be explained further hereinafter. These pin means 30 and 32 are received in molded bosses 34 and 36, respectively of housing 22. Bosses 34 and 36 are particularly shown in FIG. 1.

Figure 3:
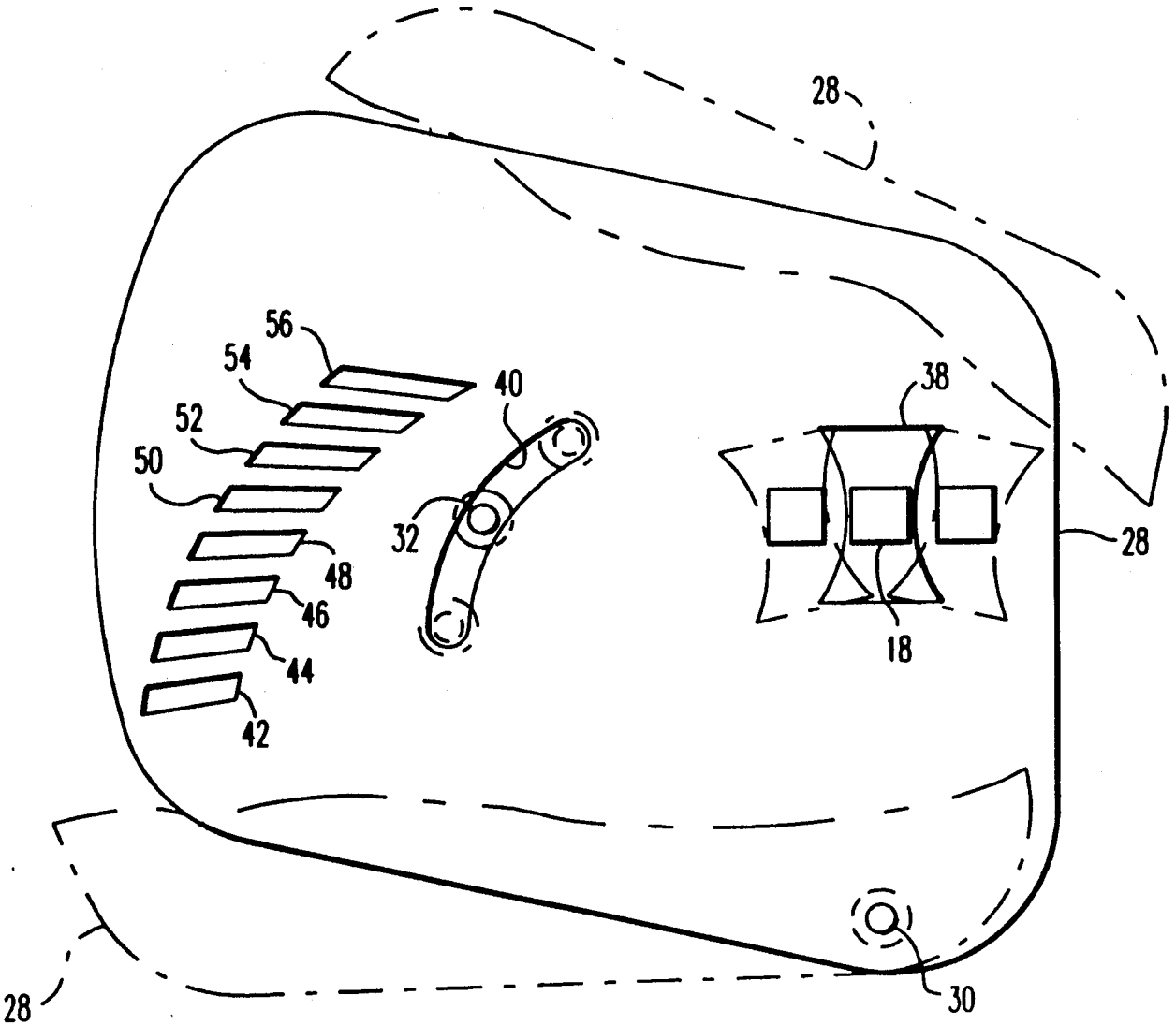
FIG. 3 is a rear view showing the several positionings for a pivot plate and switch handle for the operation of a circuit breaker and taken along lines 3—3 of FIG. 2.

As particularly shown in FIG. 3, pivot plate 28 has a butterfly opening 38, an arcuate opening 40, and a plurality of slots 42–56. These gear slots 42–56 are arranged in an arcuate path in a face of pivot plate 28.

Butterfly opening 38 receives switch handle 18 of circuit breaker 14. Its concave sides engage switch handle 18 upon movement of pivot plate 28 for movement of switch handle 18. Arcuate opening 40 receives pin means 32, and acts as a guide upon movement of pivot plate 28, when referring to FIG. 3. Pivot plate 28 is rotated or pivoted in a clockwise or counterclockwise direction through the rotation of gear plate 26 on shaft 24.

Figure 5:
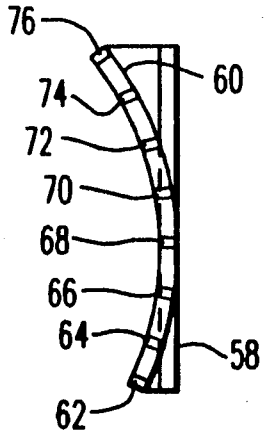
FIG. 5 is a side view taken along lines 5—5 of FIG. 4.
Figure 4:
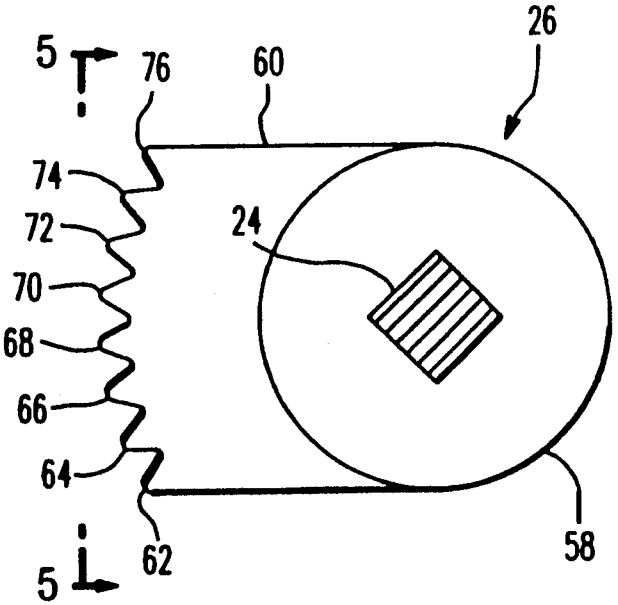
FIG. 4 is a front view of a gear plate of the invention similar to that of FIG. 2 without showing the pivot plate.

Referring particularly to FIGS. 4 and 5, gear plate 26 has a flat area 58 associated with shaft 24, and gear section 60 having several gear teeth 62–76. This gear section 60 is arcuate in both the x-y plane as shown in FIG. 4, and in the y-z plane as shown in FIG. 5. This arcuate configuration of gear section 60 is mandatory for proper meshing of gear teeth 62–76 of gear plate 26 with gear slots 42–56 of pivot plate 28.

In operation of the operating mechanism of the present invention, when toggle handle 20 is rotated in a vertical plane for the several modes of operation of circuit breaker 14, gear plate 26 is rotated, causing the gear teeth 62–76 of gear plate 26 to enter the gear slots 42–56 of pivot plate 28 to effect a pivotal movement of pivot plate 28. At least two gear teeth of gear plate 26 enter the slots of pivot plate 28. This causes the concave surfaces of butterfly opening 38 to contact switch handle 18 of circuit breaker 14, resulting in the movement of switch handle 18 in a horizontal plane.

From the above, it can be appreciated that toggle handle 20, shaft 24, gear plate 26, and pivot plate 28 are preassembled and mounted in housing 22, which, in turn can be mounted to door 16 as a unit.

When door 16 is closed, butterfly opening 40 of pivot plate 28 encircles switch handle 18 for the operation of circuit breaker 14.

Whereas particular embodiments of the invention have been described above for purposes of illustration, it will be evident to those skilled in the art that numerous variations of the details may be made without departing from the invention as defined by the appended claims.

I claim:

1. In a circuit breaker assembly, comprising:

a circuit breaker having switch handle means positioned for movement generally along the intersection of first and second intersecting planes;

toggle handle means associated with said switch handle means and mounted for movement in a third plane which is generally perpendicular to said first and said second planes, and interconnecting and translating means for interconnecting said switch handle means and said toggle handle means and for translating said movement of said toggle handle means in said third plane into said movement of said switch handle means for several modes of operation for said circuit breaker.

2. In a circuit breaker assembly of claim 1, wherein said interconnecting and translations means comprises:

pivot plate means having a first opening for receiving and engaging said switch handle means of said circuit breaker and having a plurality of gear means arranged in an arcuate path, gear plate means having gear teeth corresponding to and engaging with said gear means of said pivot plate, and shaft means for fixedly mounting said gear plate means and said toggle handle means whereby said movement of said toggle handle means causes movement of said gear plate means, which, in turn, causes movement of said pivot plate means and said switch handle means.

3. In a circuit breaker assembly of claim 1, further comprising:

an enclosure unit for receiving and supporting said circuit breaker, a hinged door on said unit, and housing means secured to said door for enclosing and supporting said interconnecting and translating means and for mounting said toggle handle means.

4. In a circuit breaker assembly of claim 2, wherein said gear means are plurality of slots, and wherein said gear plate means further consists of a flat area associated with said shaft means and an arcuate portion constructed to arrange said gear teeth of said gear plate means in an arcuate path for said engagement in said slots of said pivot plate means.

5. In a circuit breaker assembly of claim 2, wherein said pivot plate means is mounted in said one of said first or second planes for rotational movement in a clockwise or counterclockwise direction for said movement of said switch handle means, wherein said toggle handle means is mounted on said shaft means for movement in an upward and downward direction, and wherein said toggle handle means is further constructed and arranged in a manner such that upon said movement in said upward direction, said pivot plate means is rotated in said counterclockwise direction for an operating mode of said circuit breaker, and that upon said movement in said downward direction, said pivot plate means is rotated in said clockwise direction for a non-operating mode for said circuit breaker.

6. In a circuit breaker assembly of claim 2, wherein said first opening in said pivot plate means is in a butterfly configuration and has arcuate surfaces for said engagement with said switch handle means of said circuit breaker upon said movement of said pivot plate means.

7. In a circuit breaker assembly of claim 2, further comprising:

housing means for enclosing and supporting said interconnecting and translating means, and wherein said housing means and said interconnecting and translating means are assembled and mounted as a unit to said circuit breaker assembly.

8. In a circuit breaker of claim 7, wherein said housing means has first pin means and wherein said pivot plate means further consists of a second opening in an arcuate configuration for receiving said first pin means for guiding said pivot plate means in an arcuate path in said one of said first or second planes.

9. In a circuit breaker of claim 8, wherein said housing means has second pin means for pivotally mounting said pivot plate means.

10. In a circuit breaker of claim 7, wherein said housing means has an indented portion for receiving said toggle handle means which extends out of said housing means.

11. In a circuit breaker assembly, comprising:

a circuit breaker having switch handle means positioned for movement in a horizontal plane, toggle handle means associated with said switch handle means and mounted for movement in a vertical plane, means for interconnecting said switch handle means and said toggle handle means and for translating said movement of said toggle handle means in said vertical plane into said movement of said switch handle means in said horizontal plane for several modes of operation for said circuit breaker, wherein said interconnecting and translations means comprises:

pivot plate means having a first opening for receiving and engaging said switch handle means of said circuit breaker and having a plurality of gear means arranged in an arcuate path, gear plate means having gear teeth corresponding to and engaging with said gear means of said pivot plate means, and shaft means for fixedly mounting said gear plate means and said toggle handle means whereby said movement of said toggle handle means causes movement of said gear plate means, which, in turn, causes movement of said pivot plate means and said switch handle means.

12. In a circuit breaker assembly of claim 11, wherein said gear means are plurality of slots, and wherein said slots of said pivot plate means are arranged in an arcuate path on a face of said pivot plate means, and wherein said gear plate means further consists of a flat area associated with said shaft means and an arcuate portion constructed to arrange said gear teeth of said gear plate means in an arcuate path for said engagement in said slots of said pivot plate means.

13. In a circuit breaker assembly of claim 11, wherein said pivot plate means is mounted in said vertical plane for rotational movement in a clockwise or counterclockwise direction for said movement of said switch handle means is said horizontal plane, wherein said toggle handle means is mounted on said shaft means for movement in an upward and downward direction, and wherein said toggle handle means is further constructed and arranged in a manner such that upon said movement in said upward direction, said pivot plate means is rotated in said counterclockwise direction for an operating mode of said circuit breaker, and that upon said movement in said downward direction, said pivot plate means is rotated in said clockwise direction for a non-operating mode for said circuit breaker.

14. In a circuit breaker assembly of claim 11, wherein said first opening in said pivot plate means is in a butterfly configuration and has arcuate surfaces for said engagement with said switch handle means of said circuit breaker upon said movement of said pivot plate means.

15. In a circuit breaker assembly of claim 11, further comprising:

housing means for enclosing and supporting said interconnecting and translating means, and wherein said housing means and said interconnecting and translating means are assembled and mounted as a unit to said circuit breaker assembly.

16. In a circuit breaker of claim 15, wherein said housing means has first pin means and wherein said pivot plate means further consists of a second opening in an arcuate configuration for receiving said first pin means for guiding said pivot plate means in an arcuate path in said vertical plane.

17. In a circuit breaker of claim 16, wherein said housing means has second pin means for pivotally mounting said pivot plate means.

18. In a circuit breaker of claim 15, wherein said housing means has an indented portion for receiving said toggle handle means which extends out of said housing means.

* * * * *